US009981301B1

(12) United States Patent
Huang

(10) Patent No.: US 9,981,301 B1
(45) Date of Patent: May 29, 2018

(54) TUBE JIG DEVICE

(71) Applicant: YUNG CHI INDUSTRY CO., LTD., Taichung (TW)

(72) Inventor: Wu-Sheng Huang, Taichung (TW)

(73) Assignee: Yung Chi Industry Co., Ltd., Taichung (TW)

( * ) Notice: Subject to any disclaimer, the term of this patent is extended or adjusted under 35 U.S.C. 154(b) by 13 days.

(21) Appl. No.: 15/419,616

(22) Filed: Jan. 30, 2017

(51) Int. Cl.
*B21D 41/02* (2006.01)
*B21D 43/26* (2006.01)
*B21D 39/06* (2006.01)

(52) U.S. Cl.
CPC ..... *B21D 41/026* (2013.01); *B21D 39/06* (2013.01); *B21D 41/021* (2013.01); *B21D 43/26* (2013.01)

(58) Field of Classification Search
CPC ..... B21D 17/02; B21D 41/021; B21D 39/06; B21D 41/026; B21D 43/26
USPC ..... 72/460
See application file for complete search history.

(56) References Cited

U.S. PATENT DOCUMENTS 2,483,982 A * 10/1949 Paquin ..... B21D 41/021 72/116
3,421,354 A * 1/1969 Strybel ..... B21D 39/06 72/317
4,526,023 A 7/1985 Babb
6,062,060 A * 5/2000 Nguyen ..... B21D 17/02 72/317
6,199,421 B1 3/2001 Ploeger

* cited by examiner

*Primary Examiner* — David B Jones
(74) *Attorney, Agent, or Firm* — Wang Law Firm, Inc.

(57) ABSTRACT

A tube jig device for clamping a tube to be expanded by a tube flaring tool includes a base and a height gauge. The base has a plurality of gripping holes, and each of the gripping holes has a round hole and an expanding hole. The height gauge, which has a plurality of stop portions, is movably connected to the base with the stop portions on the first surface and parallel to the first surface. The height gauge is moved to a position where the stop portions are above the expanding holes respectively for the tube clamped in the gripping hole to abut against and waiting to be expanded by the tube flaring tool.

10 Claims, 13 Drawing Sheets

TUBE JIG DEVICE

BACKGROUND OF THE INVENTION

1. Technical Field

The present invention relates to a tube faring tool, and more particularly to a tube jig device to hold a tube for the tube flaring tool.

2. Description of Related Art

In the art of butt joint of two metal tubes, a size of an end of one of the tubes is changed (usually is expanded) prior to connect to the other tube. A tube jig device is applied to hold the tube for a tube flaring tool to expand the end thereof. The tube flaring tool is provided with an expander, and the expander is squeezed into the tube to expand it. The size of the tube to be expanded is determined by the size, the diameter, and a moving distance of the expander. The angle and diameter of the tube to be expanded is limited for a good condition of butt joint.

U.S. Pat. No. 4,526,023 disclosed a conventional tube jig device for a tube flaring tool to hold a tube to be expanded. User has to manually adjust a position (especially adjust the length of the tube in the jig device) of the metal tube in the tube jig device to expand an end of the tube. Adjustment by eyes is the only way the user may do for this process, and it is not precise enough for the butt joint of the tubes.

U.S. Pat. No. 6,119,421 disclosed another conventional tube jig device, which provided an anvil. The anvil is an independent element to be installed in different holes of the tube jig device according to requirements. The anvil is provided with a standard surface to abut against an end of the metal tube. As a result, the metal tube will have a predetermined length in the tube jig device to be expanded by a tube flaring tool. After the metal tube is positioned, the anvil is turned and moved to be mounted on an opposite end of the metal tube, and then the anvil is moved by an expander of the tube flaring tool to push the metal tube by the anvil for expansion. However, it is not convenient for the user to operate the anvil.

BRIEF SUMMARY OF THE INVENTION

In view of the above, the primary objective of the present invention is to provide a tube jig device for a tube flaring tool, which provides a precise and easy adjustment to position the tube in the device.

In order to achieve the objective of the present invention, a tube jig device for clamping a tube to be expanded by a tube flaring tool includes a base having a first surface and a second surface on opposite sides thereof, and a plurality of gripping holes with opposite ends open at the first and the second surfaces, wherein each of the gripping holes has a round hole and an expanding hole, and an end of the expanding hole is connected to the round hole, and an opposite end of the expanding hole is open at the first surface; a height gauge having a plurality of stop portions, wherein the height gauge is movably connected to the base with the stop portion on the first surface and parallel to the first surface; wherein the height gauge is moved to a position where the stop portions are above the expanding holes respectively for the tube clamped in the gripping hole to abut against.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
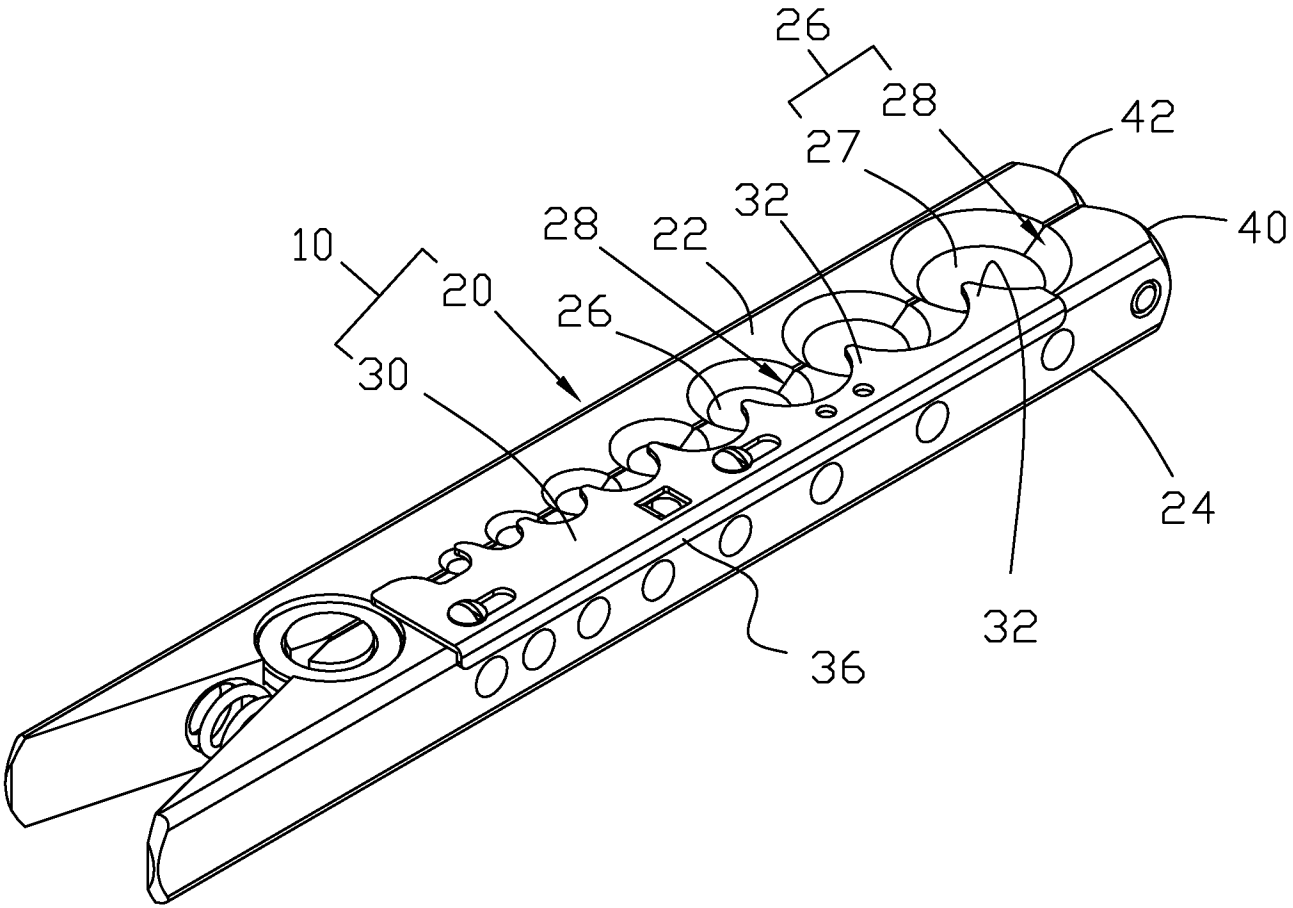
FIG. 1 is a perspective view of a preferred embodiment of the present invention.

As shown in FIG. 1, a tube jig device 10 of the preferred embodiment of the present invention includes a base 20 and a height gauge 30. The base 20 includes a first surface 22 and a second surface 24. The first surface 22 is on a top of the base 20, and the second surface 24 is on a bottom thereof. The base 20 is provided with a plurality of gripping holes 26 with opposite ends open at the first and the second surfaces 22, 24. Each of the gripping holes 26 includes a round hole 27 and an expanding hole 28. The expanding hole 28 has an inclined sidewall. In other words, a diameter of the expanding hole gradually increases from an end connected to the round hole 27 to the an end on the first surface 22.

The base includes a first base 40 and a second base 42, and the first base 40 is pivoted to the second base 42 at a position behind the holes 27, 28, and a gripping portion is formed on each of the first and the second bases 22, 24 respectively. A spring has its opposite ends urging the gripping portions of the first and the second bases 22, 24, so that the first and the second bases 22, 24 normally touch each other, and they are separated from each other when the gripping portions are exerted. The height gauge 30 is movably connected to the first base 40. The height gauge 30 includes a plurality of stop portions 32 on the first surface 22 of the base 20 and parallel to the first surface 22. The height gauge 30 further has a lip portion 36 on a lateral surface, which is between the first and the second surfaces 22, 24.

Figure 2:
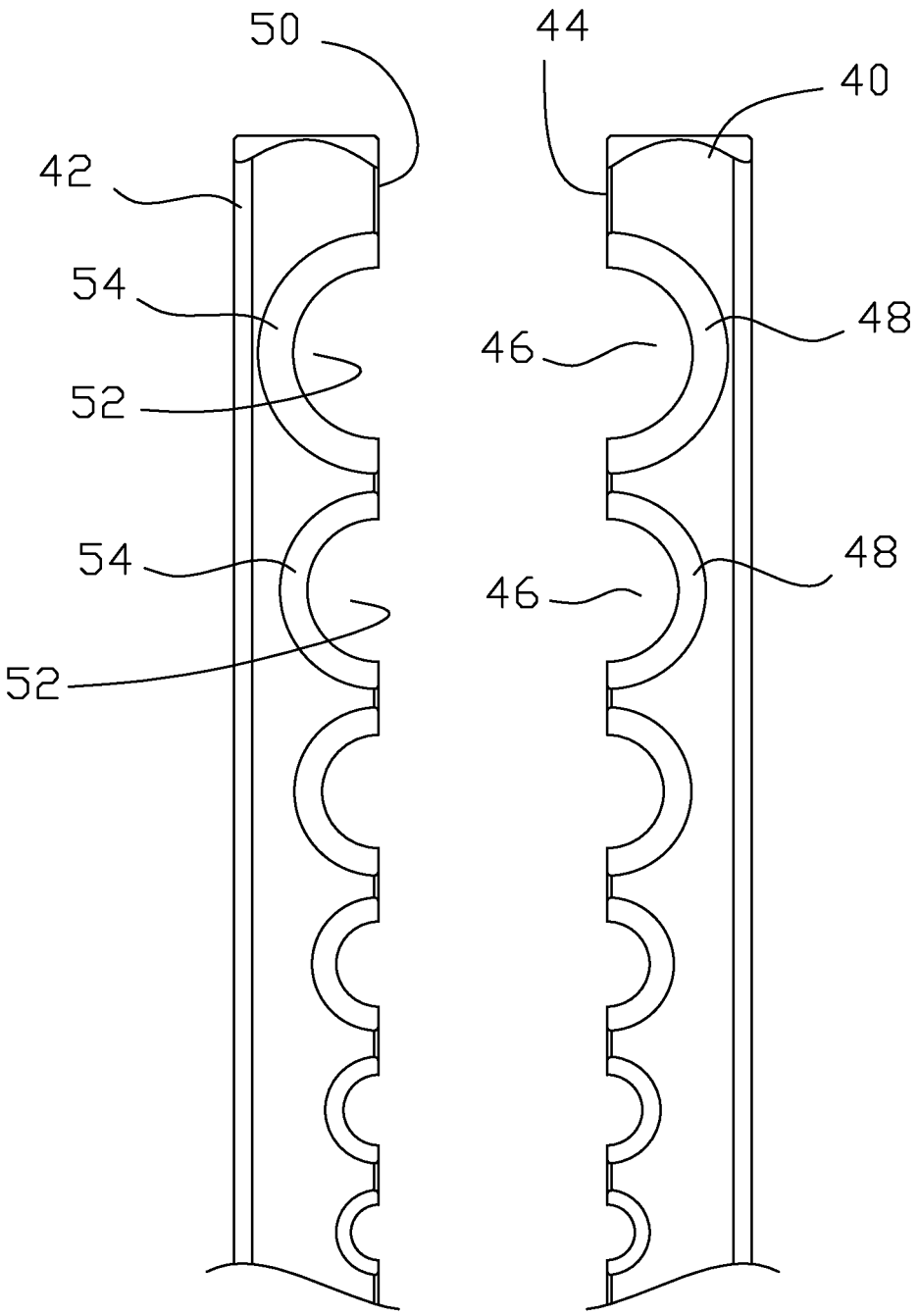
FIG. 2 is a top view of the first base and the second base of the preferred embodiment of the present invention.

As shown in FIG. 2, the first base 40 has a first holding surface 44 on a side facing the second base 42 and a plurality of first semi-cylinder holes 46 on the first holding surface 44. Each of the first semi-cylinder holes 46 is connected to a first semi-cone hole 48 respectively. The second base 42 has a second holding surface 50 associated with the first holding surface 44 of the first base 40 and a plurality of second semi-cylinder holes 52 on the second holding surface 50 and associated with the first semi-cylinder holes 46 of the first base 40. Each of the second semi-cylinder holes 52 is connected to a second semi-cone hole 54 respectively.

Figure 3:
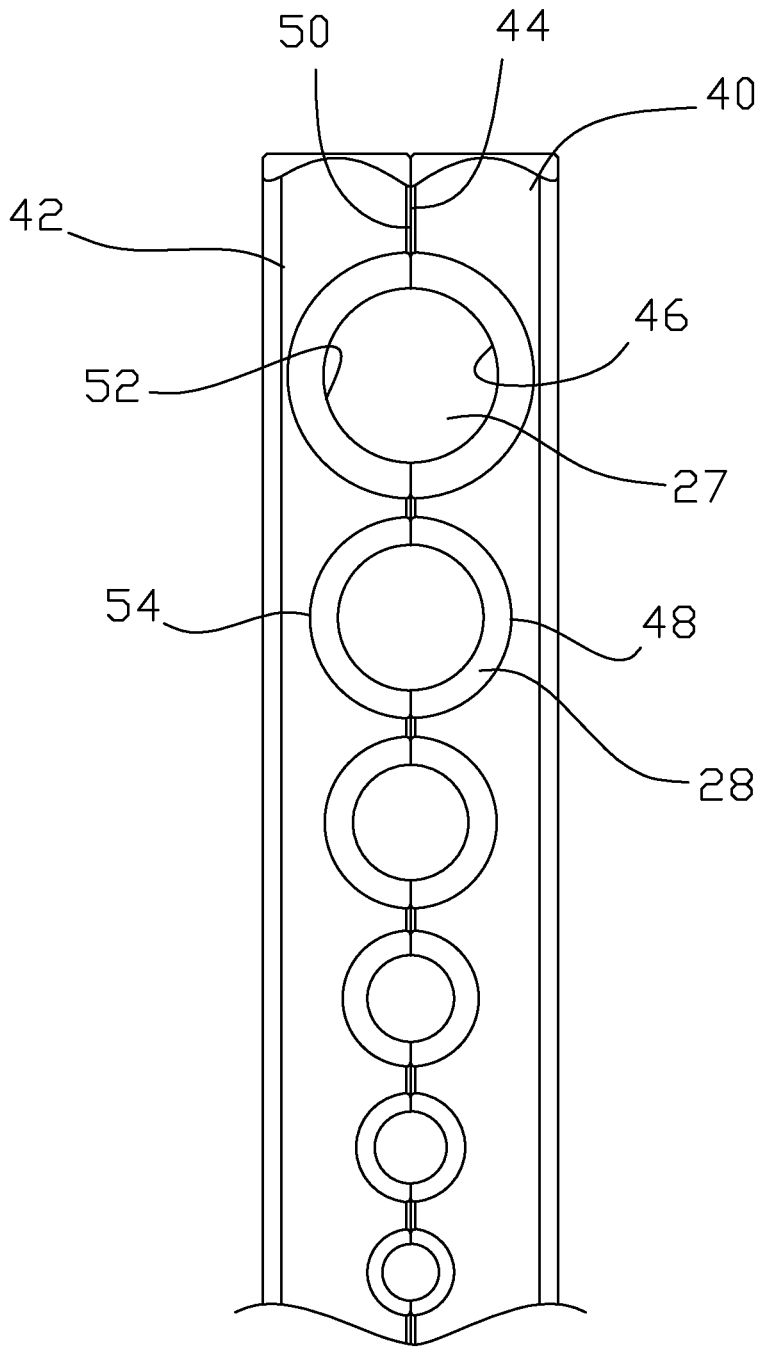
FIG. 3 is a top view of the first base and the second base in combination of the preferred embodiment of the present invention.

As shown in FIG. 3, in a normal condition, the first holding surface 44 touches the second holding surface 50, the first semi-cylinder holes 46 are combined with the second semi-cylinder holes 52 to form the round holes 27, and the first semi-cone holes 48 are combined with the second semi-cone holes 54 to form the expanding holes 28.

Figure 4:
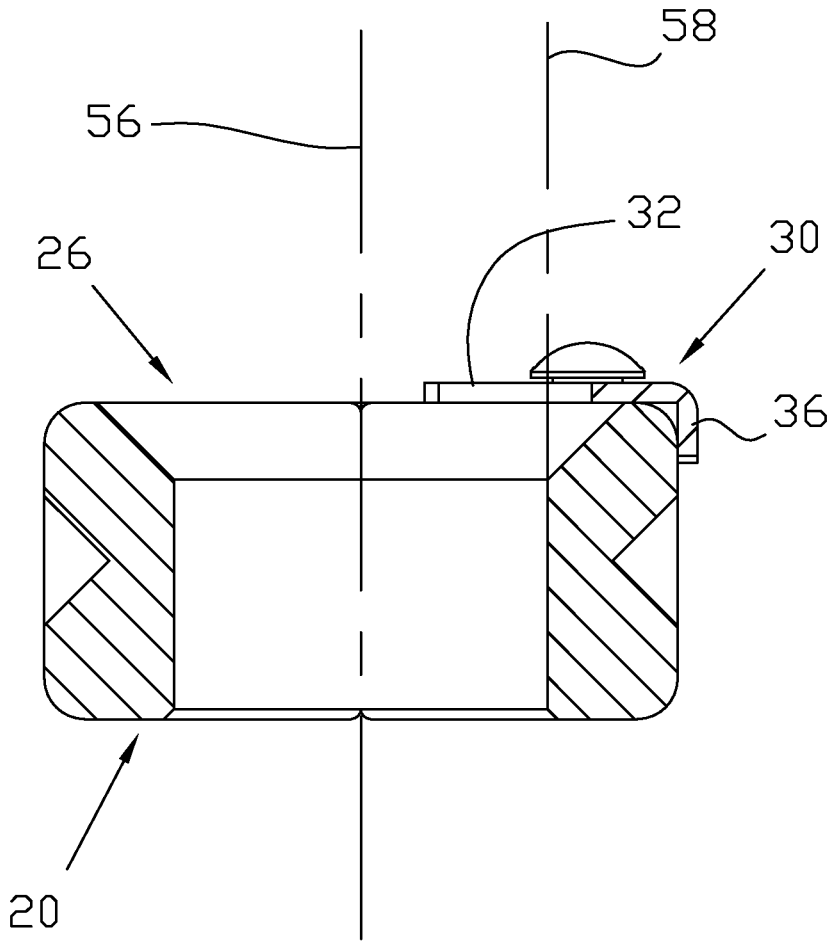
FIG. 4 is a sectional view of the preferred embodiment of the present invention, showing the gripping hole and the stop portion.
Figure 5:
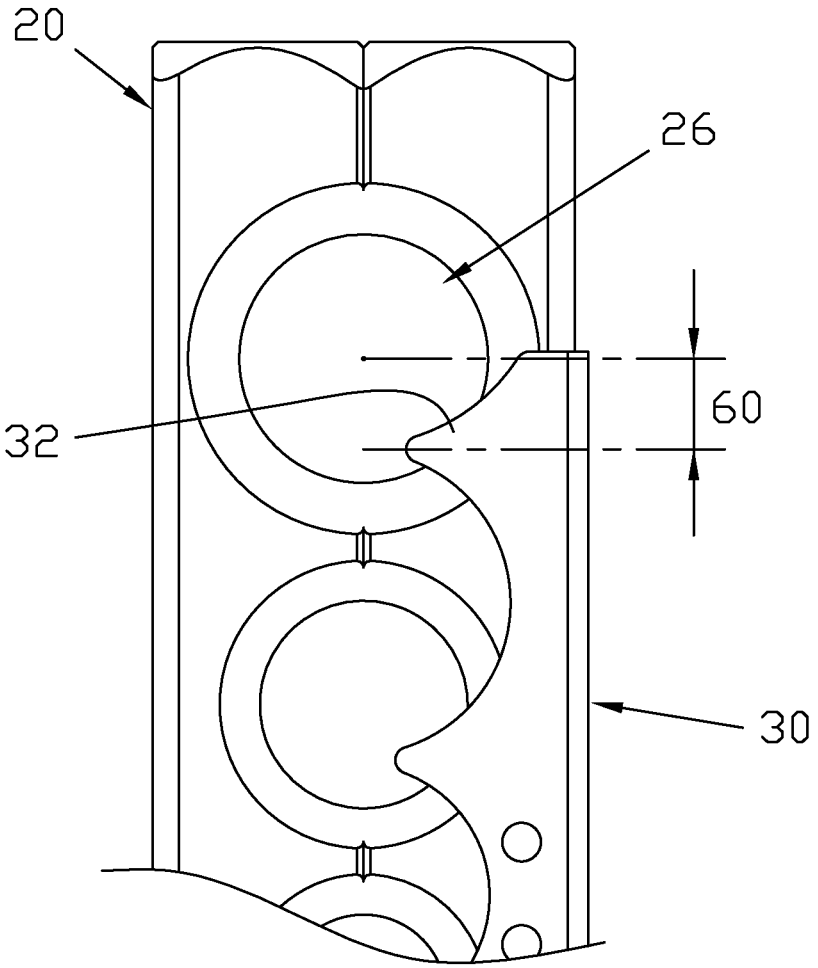
FIG. 5 is a top view of the preferred embodiment of the present invention, showing the gripping hole and the stop portion.

As shown in FIG. 4, each of the gripping holes 26 has an axial line 56 at a center thereof and an extending line 58 along the sidewall (precisely, it is on the round hole's sidewall) thereof, and the axial line 56 is parallel to the extending line 58. Each of the stop portions 32 of the height gauge 30 has a portion between the axial line 56 and the extending line 58. As shown in FIG. 5, a deviation 60 is formed between a center of the stop portion 32 and the axial line 56 of the corresponding gripping hole 26. An included angle between the stop portions 32 and the lip portion 36 is about 90 degrees, so that the stop portions 32 are on the first surface 22, and the lip portion is on the lateral surface.

Figure 6:
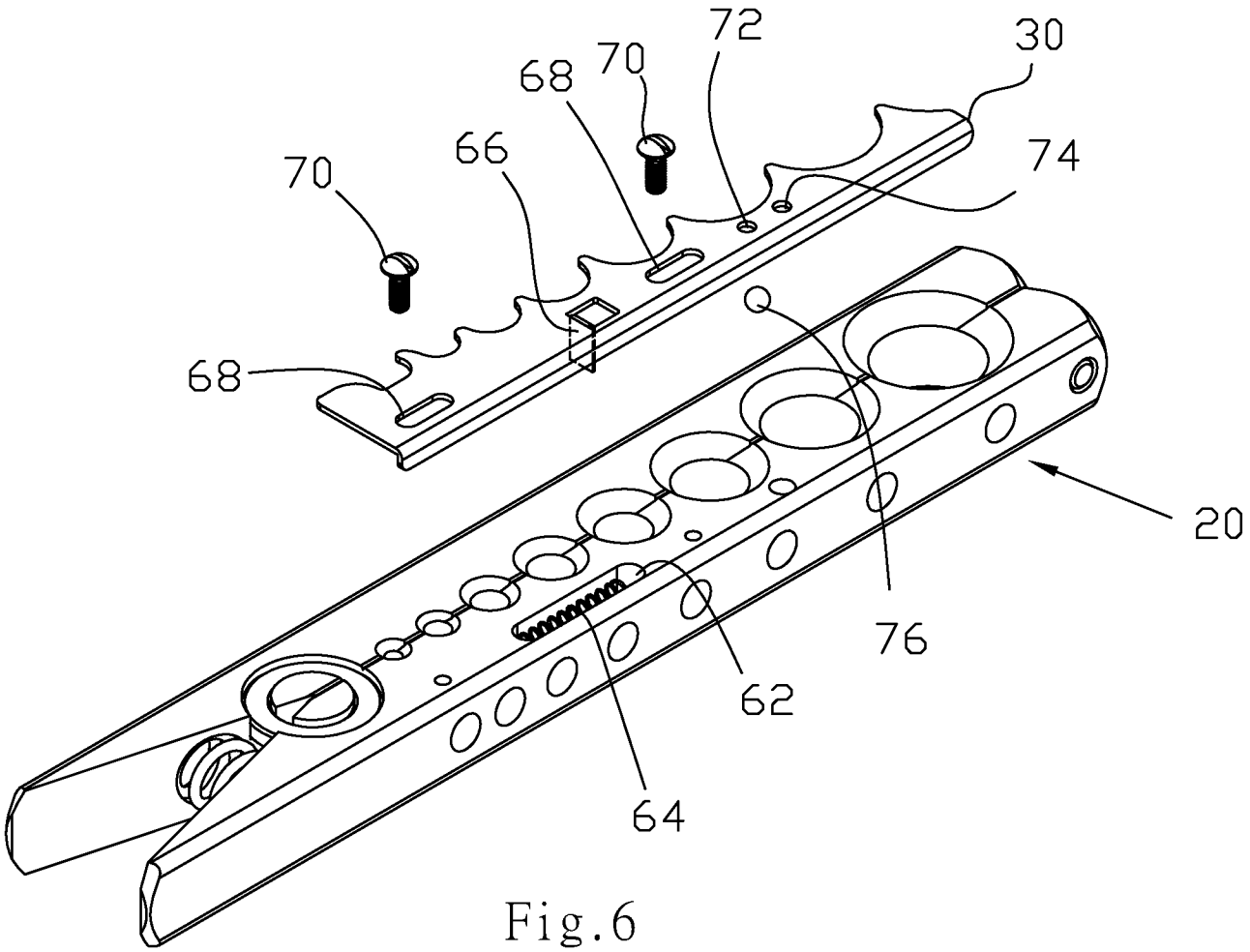
FIG. 6 is an exploded view of the preferred embodiment of the present invention.
Figure 7:
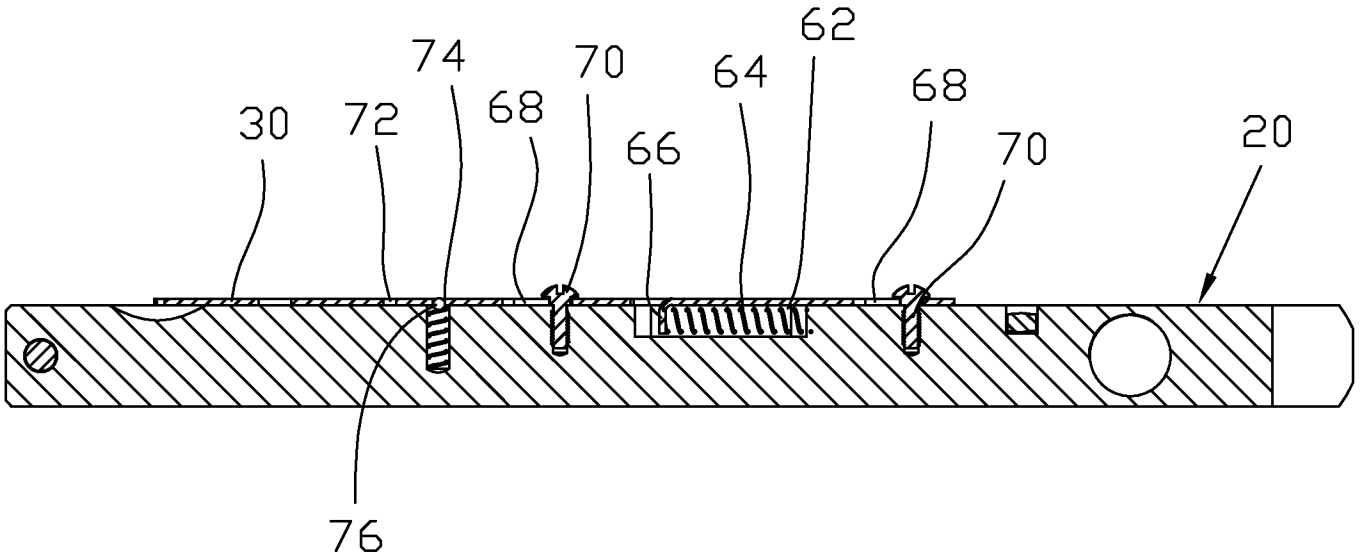
FIG. 7 is a sectional view of the preferred embodiment of the present invention, showing the return spring and the driving portion of the height gauge.

As shown in FIGS. 6 and 7, the base 20 is provided with a receiving slot 62 under the height gauge 30 and a return spring 64 received in the receiving slot 62. The height 30 is provided with a driving portion 66. The height gauge 30 further includes two elongated shifting holes 68 and two guiding members 70.

The height gauge 30 is fixed to the base 20 by the guiding members 70 inserted into the shifting holes 68 and secured to the base 20, and the driving portion 66 is received in the receiving slot 62 and abutted against the return spring 64.

The height gauge 30 further includes a first positioning hole 72, a second positioning hole 74, and a positioning member 76. In the present embodiment, the positioning member 76 includes a spring and a ball received in a hole on the base 20.

With the structure as described above, the height gauge 30 is able to be moved on the base 20 in a predetermined distance because of the engagement of the elongated shifting holes 68 and the guiding members 70. The return spring 64 urges the driving portion 66 of the height gauge 30 may return the height gauge 30 to its initial position after it is released.

Figure 8:
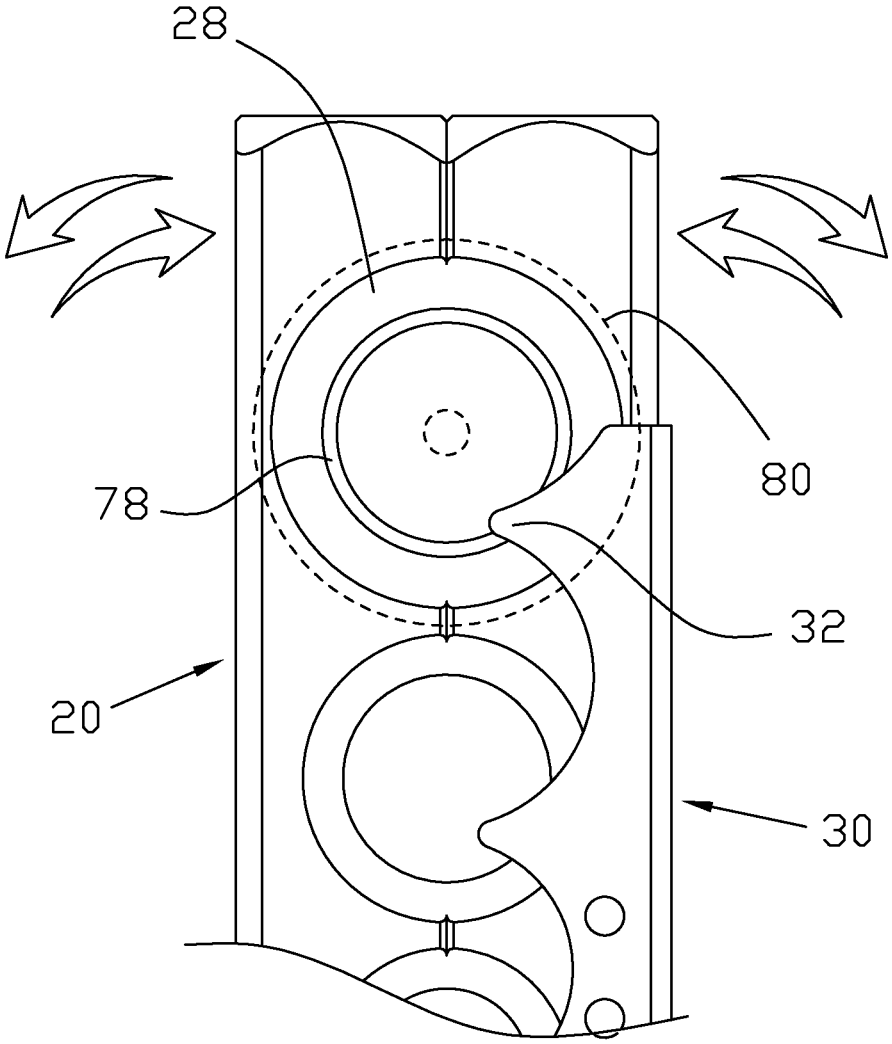
FIG. 8 is a top perspective view of the preferred embodiment of the present invention.
Figure 9:
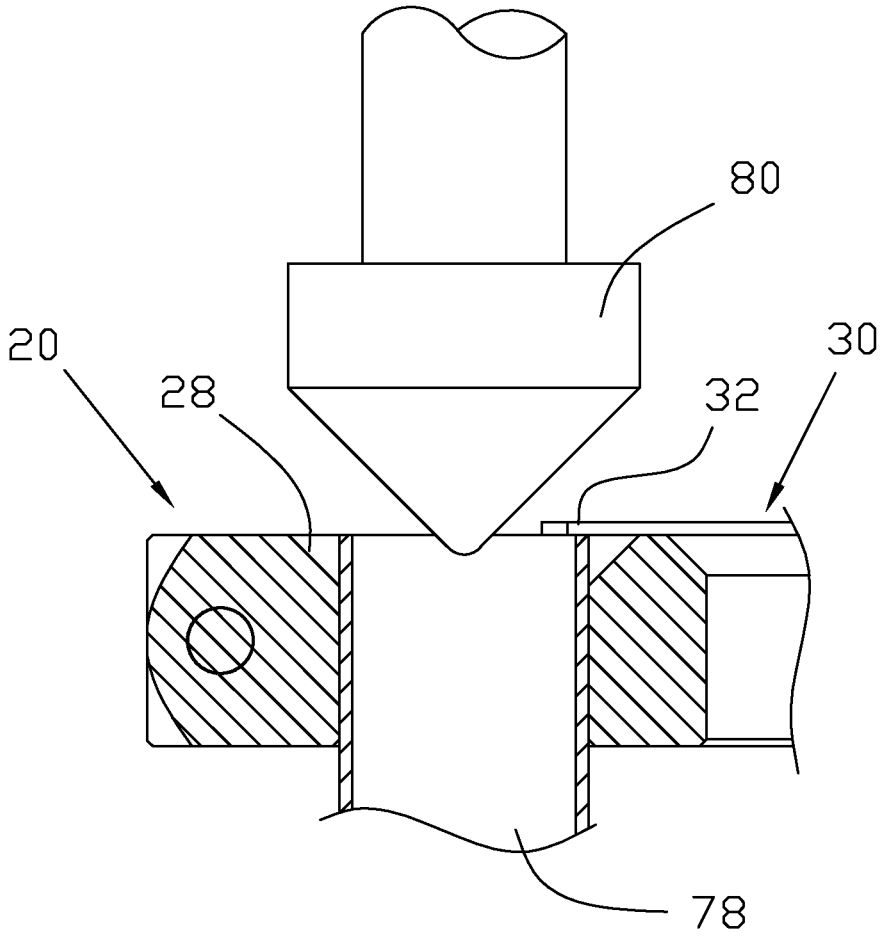
FIG. 9, FIG. 10, and FIG. 11 are sectional views of the preferred embodiment of the present invention, showing the expander expanding the tube.

As shown in FIGS. 8 and 9, a user may exert the gripping portions of the base 20 to clamp a tube 78 in one of the gripping holes 26, and then the height gauge 30 is adjusted to have the stop portion 32 against an end of the tube 78. An expander 80 is moved toward the end of the tube 78 to expand it. Since the stop portion 32 abuts against the end of the tube 78, a predetermined length of the tube 78, which is equal to a depth of the expanding hole 28, is received in the expanding hole 28. In other words, a constant length of the tube 28 is kept in the expanding hole 28.

Figure 10:
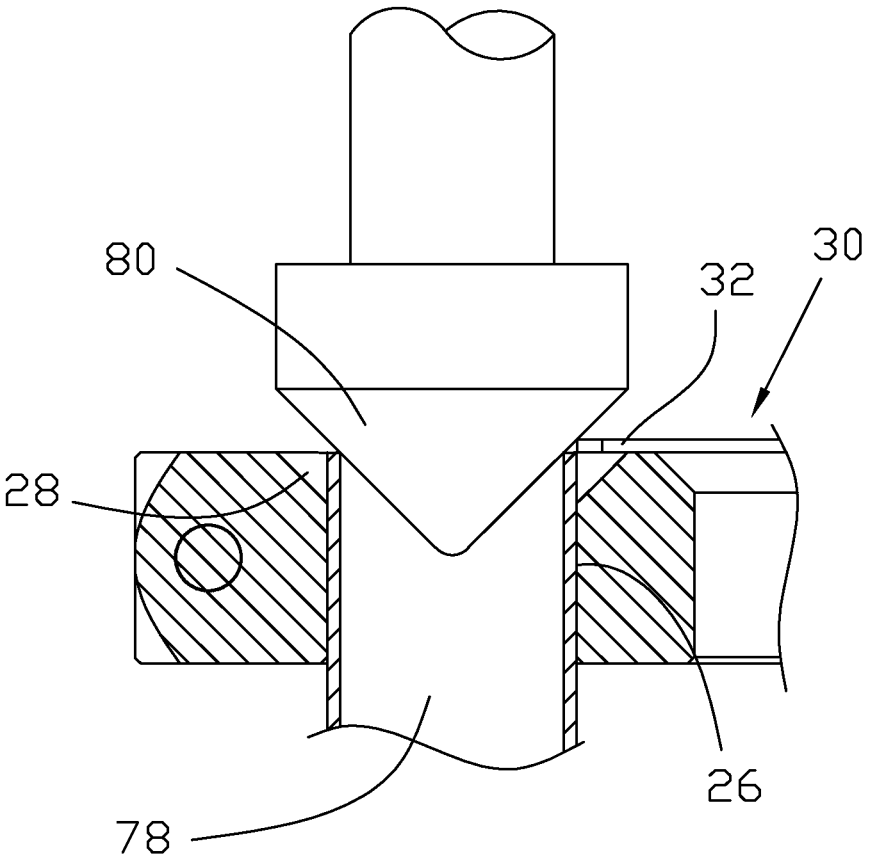
Figure 11:
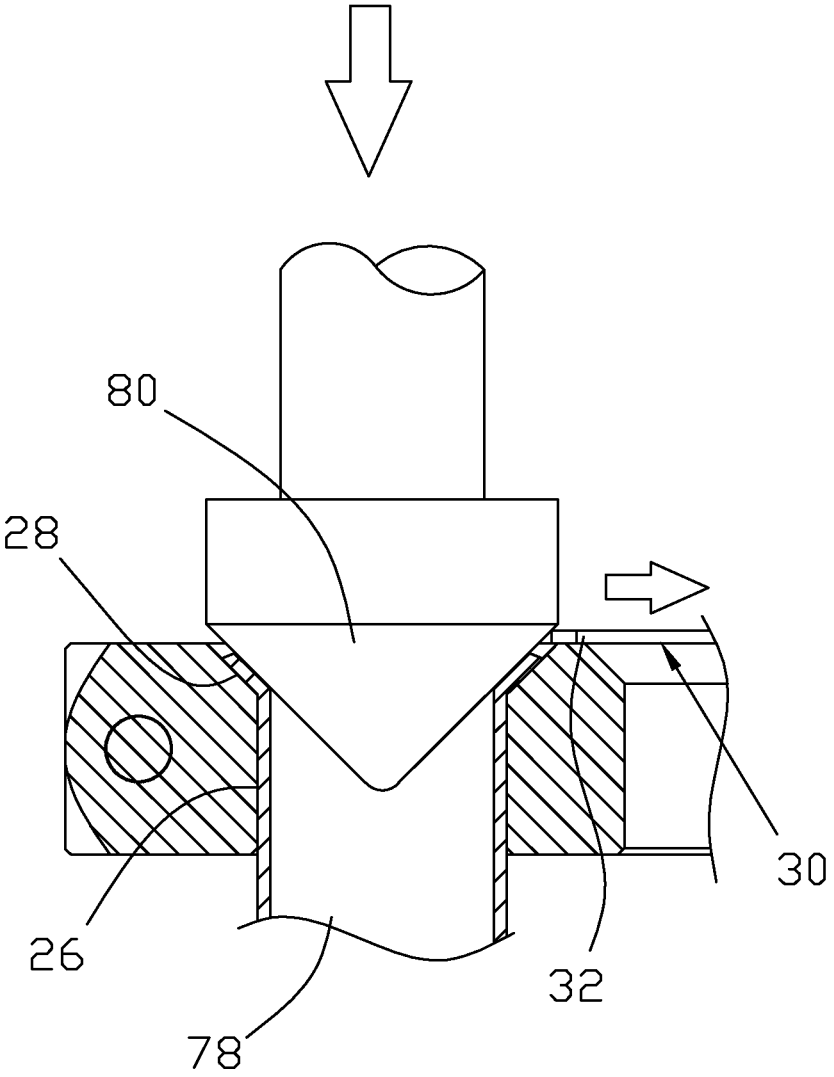

As shown FIGS. 10 and 11, since the stop portion 32 is not at the center of the expanding hole 28, the expander 80 may move the stop portion 32 off the expanding hole 28 by it cone-like tip when the expander 80 is moved toward the tube 78. In other words, the height gauge 30 automatically move to have the stop portion 32 away from the expanding hole 28 when the expander 80 expands the tube 78. Furthermore, the inclined sidewall of the expanding hole 28 determines an angle and a shape of the expanded end of the tube 78.

User does not need to move the height gauge 30 when the expander 80 expands the tube 80, so the expanding process with the tube jig device 10 of the present invention is very easy.

Figure 12:
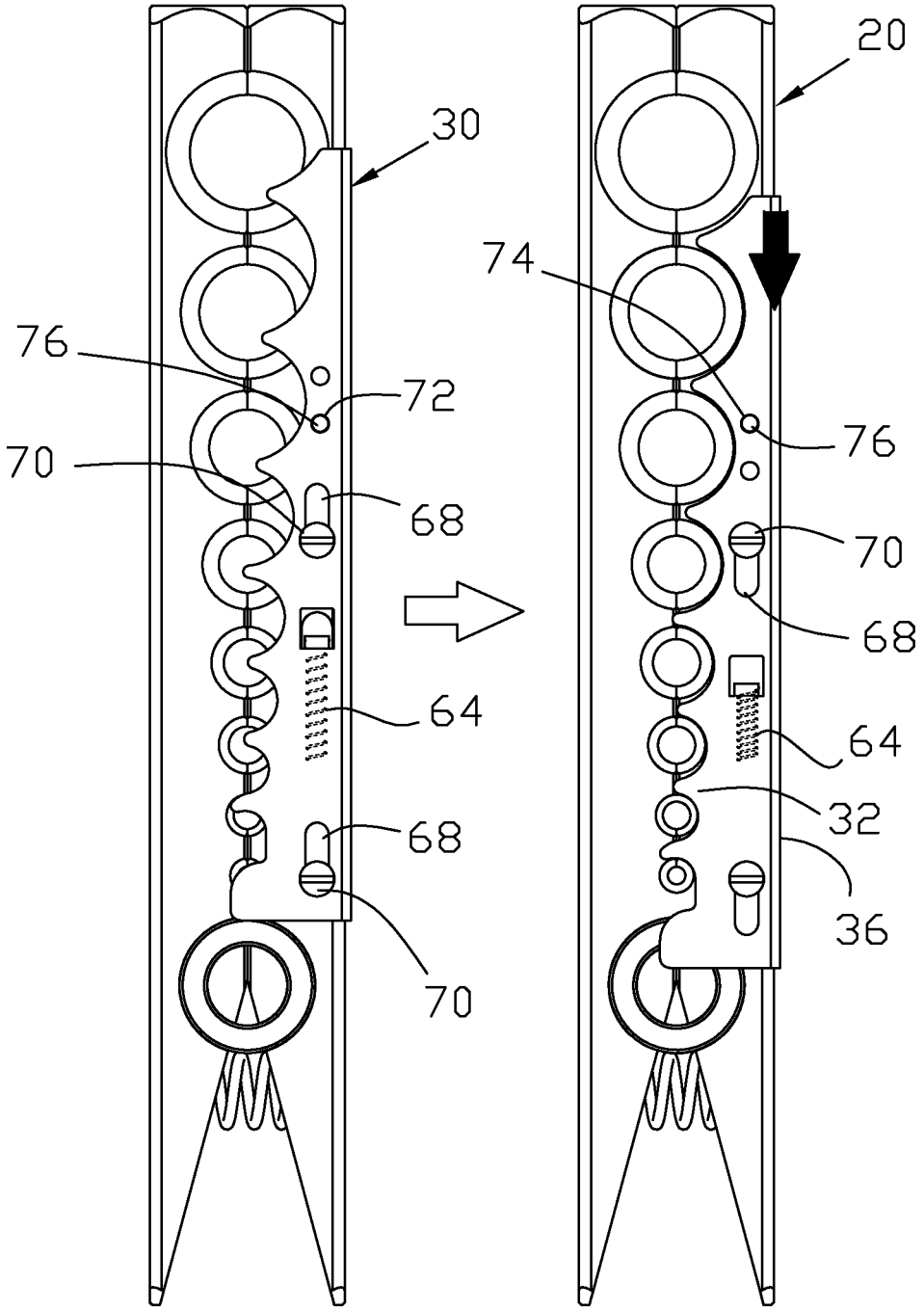
FIG. 12 is a top view of the preferred embodiment of the present invention, showing, showing the movement of the height gauge.

As shown in FIG. 12, the guiding members 70 move in the shifting holes 68 when the height gauge 30 is moved. It could guide and limit the movement of the height gauge 30, and prevent the height gauge 30 tilted to stabilize the height gauge 30. In addition, the perpendicular lip portion 36 of the height gauge 30 helps to stabilize the movement of the height gauge 30 as well.

When the height gauge 30 is located at its initial position, the positioning member 76 engages the first positioning hole 72 to position the height gauge 30 at the initial position, and the positioning member 76 engages the second positioning hole 74 when the height gauge 30 is moved by the expander 80 to temporarily position the height gauge 30 for expanding process. After the expanding process is completed and the expander 80 is moved backward, the return spring 64 forces the height gauge 30 back to the initial position automatically.

Figure 13:
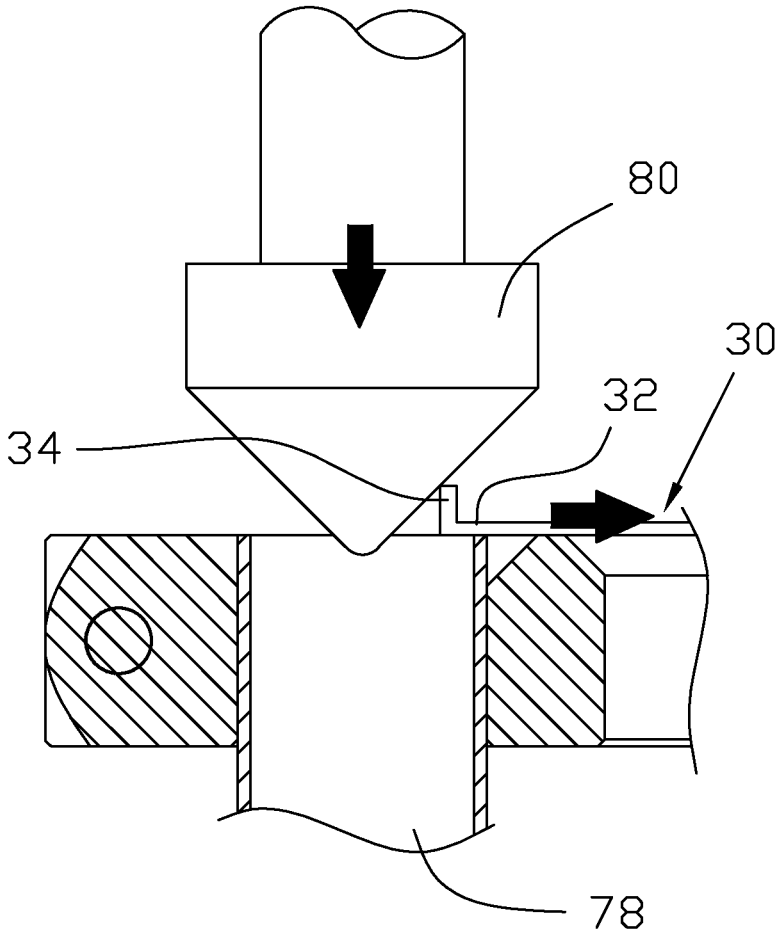
FIG. 13 is a sectional view of the preferred embodiment of the present invention, showing the height gauge with the contacting portion.

As shown in FIG. 13. Each of the stop portions 32 is provided with a contacting portion 34 at a distal end thereof. In the present embodiment, the contacting portion 34 is an upward bent section at the distal end of the stop portion 32, in other words, a distal end of the contacting portion 34 is higher than the stop portion 32. The expander 80 may touch the contacting portion 34 earlier to move the height gauge 30 in advance to reduce the interference of the stop portion 32 to the expander 80.

In conclusion, the present invention provides the stop portions 32 of the height gauge 30 to limit the position of the tube 78 in the expanding hole 28 that could provide a better and consistent expanding process.

It must be pointed out that the embodiments described above are only some preferred embodiments of the present invention. All equivalent structures which employ the concepts disclosed in this specification and the appended claims should fall within the scope of the present invention.

What is claimed is:

1. A tube jig device for clamping a tube to be expanded by a tube flaring tool, comprising:

a base having a first surface and a second surface on opposite sides thereof, and a plurality of gripping holes with opposite ends open at the first and the second surfaces, wherein each of the gripping holes has a round hole and an expanding hole, and an end of the expanding hole is connected to the round hole, and an opposite end of the expanding hole is open at the first surface; and a height gauge having a plurality of stop portions, wherein the height gauge is movably connected to the base with the stop portions on the first surface and parallel to the first surface;

wherein the height gauge is moved to a position where the stop portions are above the expanding holes respectively for the tube clamped in the gripping hole to abut against.

2. The tube jig device of claim 1, wherein the gripping hole has an axial line at a center thereof and an extending line along a sidewall thereof, and the stop portion has a portion above the gripping hole and between the axial line and the extending line.

3. The tube jig device of claim 1, wherein the base is provided with a receiving slot, in which a return spring is received; the height gauge is provided with a driving portion received in the receiving slot and urged by the return spring.

4. The tube jig device of claim 1, wherein the height gauge is provided with an elongated shifting hole; a guiding member passes through the shifting hole and is secured to the base, whereby the guiding member reciprocates in the shifting hole when the height gauge is moved.

5. The tube jig device of claim 1, wherein the height gauge is provided with a first positioning hole and a second positioning hole, and the base is provided with a positioning member to engage the first positioning hole or the second positioning hole when the height gauge is moved.

6. The tube jig device of claim 1, further comprising a return spring with opposite ends urging the base and the height gauge.

7. The tube jig device of claim 6, wherein the base is provided with a receiving slot, in which the return spring is received; the height gauge is provided with a driving portion received in the receiving slot and urged by the return spring.

8. The tube jig device of claim 1, wherein the base has a first base and a second base; the first base has a first holding surface on a side facing the second base and a plurality of first semi-cylinder holes on the first holding surface; the second base has a second holding surface on a side facing the first holding surface of the first base and a plurality of first semi-cylinder holes on the first holding surface; the first base is pivoted on the second base, so that the first base is moved toward the second base to have the first holding surface touching the second holding surface, and the first semi-cylinder holes are combined with the second semi-cylinder holes respectively to form the round holes, and the first semi-cone holes are combined with the second semi-cone holes respectively to form the expanding holes; the height gauge is movably connected to the first base.

9. The tube jig device of claim 6, wherein each of the stop portions of the height gauge has a contacting portion to be adapted to touch an expander of the tube flaring tool.

10. The tube jig device of claim 1, wherein the height gauge further has a lip portion, and an included angle is form between the lip portion and the stop portion; the lip portion is associated with a lateral surface, which is between the first surface and the second surface, of the base.

* * * * *